US006145671A

United States Patent [19]

Riga et al.

[11] Patent Number: 6,145,671

[45] Date of Patent: Nov. 14, 2000

[54] INTEGRATED DISPLAY SYSTEM FOR DEATH CARE MERCHANDISE

[75] Inventors: Dennis J. Riga, New Albany; Marta Monserrate, Lockbourne, both of Ohio

[73] Assignee: The York Group, Inc., Houston, Tex.

[21] Appl. No.: 09/115,159

[22] Filed: Jul. 14, 1998

[51] Int. Cl.[7] ..... A47F 5/00

[52] U.S. Cl. ..... 211/13.1; 211/85.16; 211/187; 108/92; 108/101; 40/538

[58] Field of Search ..... 211/13.1, 189, 211/85.16, 186, 187, 128.1; 312/245, 357.1; 108/108, 92, 101, 109; 40/538

[56] References Cited

U.S. PATENT DOCUMENTS

| | | | |
|---|---|---|---|
| D. 182,507 | 4/1958 | Doblin | D6/479 X |
| D. 221,493 | 8/1971 | Stephens, Jr. | D6/474 X |
| 899,052 | 9/1908 | Imus . | |
| 1,146,488 | 7/1915 | Finkelstein . | |
| 1,713,908 | 5/1929 | Lane . | |
| 2,326,493 | 8/1943 | Pringle et al. . | |
| 3,828,937 | 8/1974 | Nash | 211/86.01 |
| 3,874,753 | 4/1975 | Naito et al. | 211/186 X |
| 4,082,388 | 4/1978 | Goeglein | 312/257.1 |
| 4,526,110 | 7/1985 | Franz | 108/108 |
| 4,540,222 | 9/1985 | Bunell | 312/257.1 |
| 4,716,841 | 1/1988 | Suttles | 108/108 |
| 5,199,775 | 4/1993 | Morgan et al. | 312/257.1 |
| 5,405,017 | 4/1995 | Szabo, Sr. et al. | 211/13.1 |
| 5,787,626 | 8/1998 | Bingham et al. | 312/234 X |
| 5,797,499 | 8/1998 | Pinco | 211/13.1 |
| 5,848,498 | 12/1998 | Szabo, Sr. et al. | 52/36.1 |
| 5,901,862 | 5/1999 | Riga et al. | 211/85.16 |

*Primary Examiner*—Robert W. Gibson, Jr.
*Attorney, Agent, or Firm*—Stevens, Davis, Miller & Mosher, L.L.P.

[57] ABSTRACT

A death care merchandise display unit maximizes the display of miniature death care merchandise products. The display unit has two vertical, parallel, spaced wing wall panels and a vertical back wall having lateral edges secured to the rear edges of the wing wall panels. Fixtures for holding miniature replicas of various death care merchandise articles are adfixed to the wall panels and the vertical back walls. One or more display surfaces are preferably further contained within the display unit.

24 Claims, 5 Drawing Sheets

INTEGRATED DISPLAY SYSTEM FOR DEATH CARE MERCHANDISE

FIELD OF THE INVENTION

The present invention relates to an integrated display system for death care merchandise such as caskets, coffins, urns, burial vaults and materials for decorating or adorning or promoting or advising the same. The display system of the invention is particularly designed for use by prospective purchasers in a preview room. The display system includes an apparatus by which miniaturized death care merchandise is displayed along with the decorative adornment options in a single display unit. A portion of the unit may be reserved for the display of promotional or advisory information relating to the displayed merchandise. The display unit may further include an optional roll out storage space for other death care merchandise display components.

BACKGROUND OF THE INVENTION

Various death care display systems are known in the art. The more primitive of such systems consist of a casket display rack or support. See, for instance, U.S. Pat. No. 2,937,768 which discloses a two-tiered casket display rack having a rigid C-shaped frame-like structure for the display of two caskets—one casket supported above another.

U.S. Pat. No. 5,405,017 discloses a more contemporary casket display system for full caskets. The display system of the '017 patent includes a two-tiered casket display rack retractable by means of a scissors unit which, in turn, is connected to a rod. The display rack of the '017 patent is not an integral part of the casket display system.

While the casket display system of the '017 patent offers a more serene setting than the primitive systems of the prior art, as set forth in the '768 patent, it does not permit the display of all merchandise used in the funeral and death care industry especially relating to burial vaults and urns. In addition, it does not permit the display of adornment accessories for death care merchandise. In particular, the showing of burial vaults is problematic due to the fact that their size must exceed the size of a casket. Thus, the display of burial vaults is more suited to the display of miniatures.

The need exists therefore for a display system which permits the exhibition of a greater volume and a greater type of death related merchandise at greater ease for the prospective purchaser. However, with displays of miniatures, adornments on them will not be plainly visible to the casual observer. Therefore, a display unit capable of showing numerous miniatures of death care merchandise along with full size adornments is needed.

SUMMARY OF THE INVENTION

A death care merchandise display unit which maximizes the display of miniature death care merchandise products along with full size examples of their adornments comprise two vertical, parallel, spaced wing wall panels and a vertical back wall having lateral edges secured to the rear edges of the wing wall panels. Placed on the wall panels and the vertical back walls are attachments for holding miniature replicas of various death care merchandise articles. These can be attachments for holding the replicas directly, or for shelving adapted to fit the death care merchandise.

The vertical back wall can be divided into sections denoting the line of death care merchandise. Or the sections can be used to display different types of death care merchandise. Adapted to and fitted to the vertical back wall or the side wing walls are surfaces for the display of adornments to the death care merchandise displayed on the attachments. Thus, a complete line of bulky death care merchandise can be displayed in miniature, and the optional adornments to them can also be displayed in the same unit in full size. This unit allows a full range of options to be presented to the consumer, and the detail of the adornments is not diminished.

Further, a cornice may extend across the top of the back panel adfixed to the side wing walls or may extend outwards from the back panel. The cornice could be decorated with geometric patterns or contain an aid to the consumer indicating either the lines of merchandise being displayed, or any other message the retailer wishes to convey pertaining to the merchandise.

DETAILED DESCRIPTION OF THE PREFERRED EMBODIMENTS

The present invention provides an integrated display system for death care related merchandise. The display system of the invention is principally used in a preview room where selection of death care related merchandise by the decedent's loved ones occurs. In addition, the display system of the invention may be used in death related ceremonial areas such as the viewing room of a funeral home as well as at funeral and memorial services.

The display system of the invention is defined by a back wall and side or wing walls. One of the principal advantages of the display system of the present invention is that it allows the display of an extensive line of death care merchandise in a limited space. An entire line of caskets, burial chambers, burial vaults, urns, or other death care merchandise can be shown via miniature replicas of the actual merchandise. Thus, a consumer can look over an entire line of products in the same space that previously only served to show only a few full size products. Thus, great advantages in space are achieved through the use of miniature replicas and through the use of a display system allowing the display of replicas along with full size representations of the optional adornments.

Figure 1:
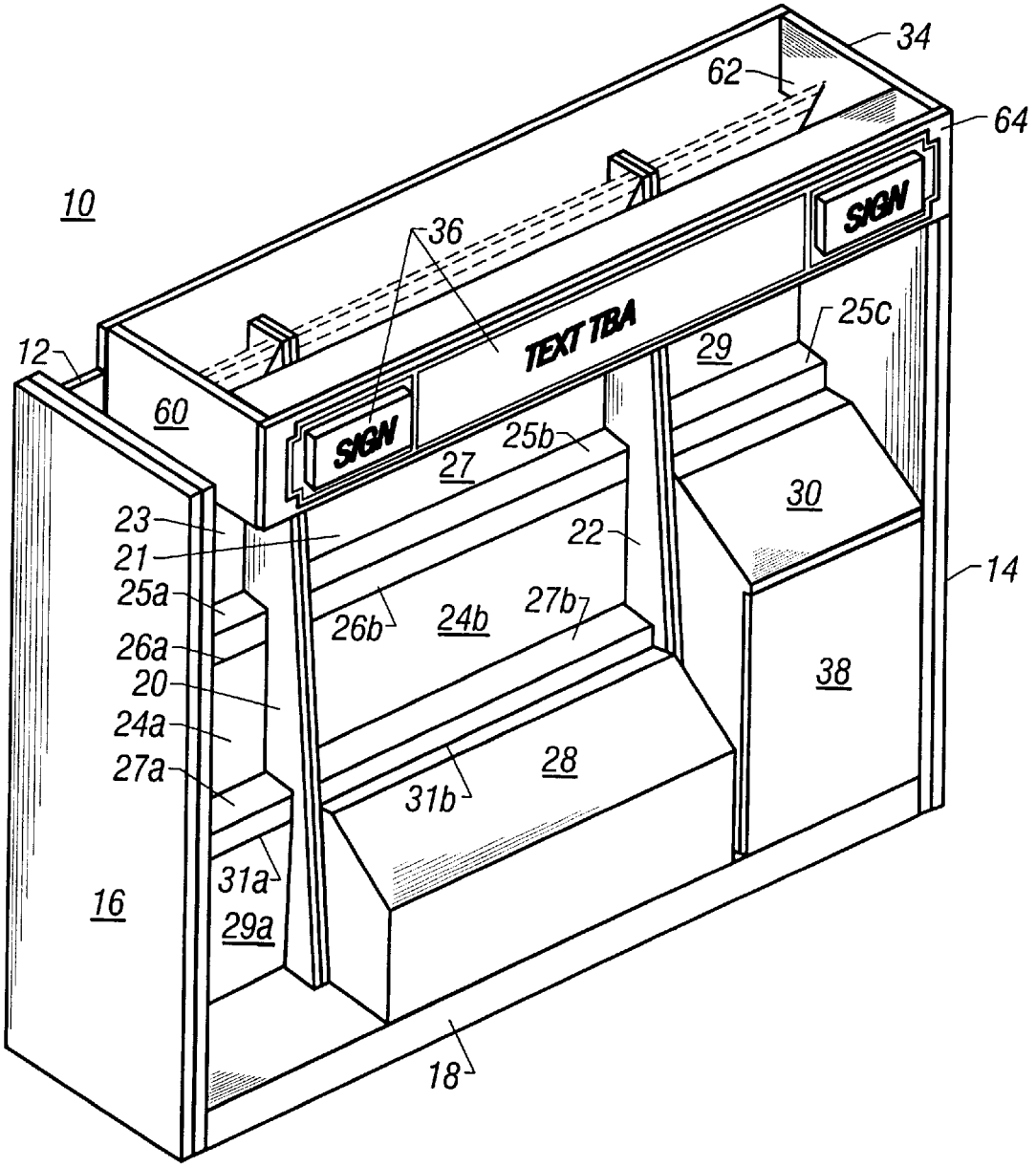
FIG. 1 is a frontal view of one embodiment of the display unit of the invention.

The display system contains a number of novel features which may be used alone or in combination with each other. FIG. 1 shows an embodiment of the death care merchandise display system 10 of the invention, principally for use in preview rooms. The display system 10 comprises a back wall 12 and two side or wing walls 14 and 16. Wing walls 14 and 16 are connected with back wall 12 at the rear section of the wing wall. The vertical back wall 12 may be removably secured to the rear edges of wing walls 14 and 16.

FIG. 1 shows the preferred embodiment of display system 10 having a floor panel 18. However, floor panel 18 is not required and may be omitted. One useful effect of floor panel 18 is that it serves to strengthen or buttress the entire structure of display system 10.

In the preferred embodiment, display unit 10 has subdividers 20 and 22 separating various sections of the display system. Back wall panel 12 may be divided into discrete subsections depending on the intent of the designer. See, for instance, FIG. 1, where subsections 23, 27 and 29 are used to separate product lines by pricing or quality, or the subsections can be used to display various different articles of death care merchandise. The top section of each subsection, such as 21, is preferably used to convey information about the merchandise being displayed.

In addition, subdividers 20 and 22 can be constructed to lend support to back wall 12. If floor panel 18 is present, subdividers 20 and 22 can be attached to the top of floor panel 18, or may be guided through floor panel 18. If floor panel 18 is not present, subdividers 20 and 22 could meet the surface display system 10 rests on. In either case, subdividers 20 and 22 can serve to support display system 10 against tipping or warping forces as well as subdivide display system 10 into functionally related areas. Subdividers 20 and 22 are typically crafted to fit into notched grooves of back wall panel 12. In an alternative construction, the back wall may consist of three distinct panels separated by subdividers 20 and 22.

In the preferred embodiment, merchandise display support panels 24*a* and 24*b* are added to back wall 12. These merchandise support panels act to reinforce back wall 12 for heavier scale replicas, such as miniature burial chambers made of a dense solid. Merchandise attachment points, such as slots 26*a* and 26*b*, serve to support either the death care merchandise itself, or shelving adapted to display the death care merchandise. It should be noted that slots 26 is only one of a number of ways to attach items or shelving to display system 10, and the invention should be construed to include all known means of attaching merchandise or shelving to back wall 12. Other known means for removably attaching objects include, e.g., peg-board type attachments, slat wall, tackable surfaces, hook-and-loop fabric (e.g., VELCRO®) attachments, magnetic attachments or other known devices for removably attaching objects to a vertical surface for display of the objects.

Figure 2A:
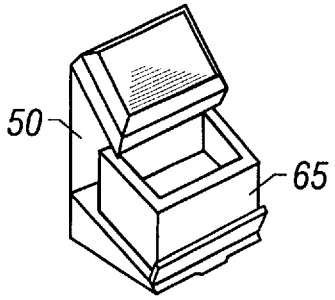
FIGS. 2A–2D are frontal views of the attachments for displaying miniature death care merchandise units.
Figure 4:
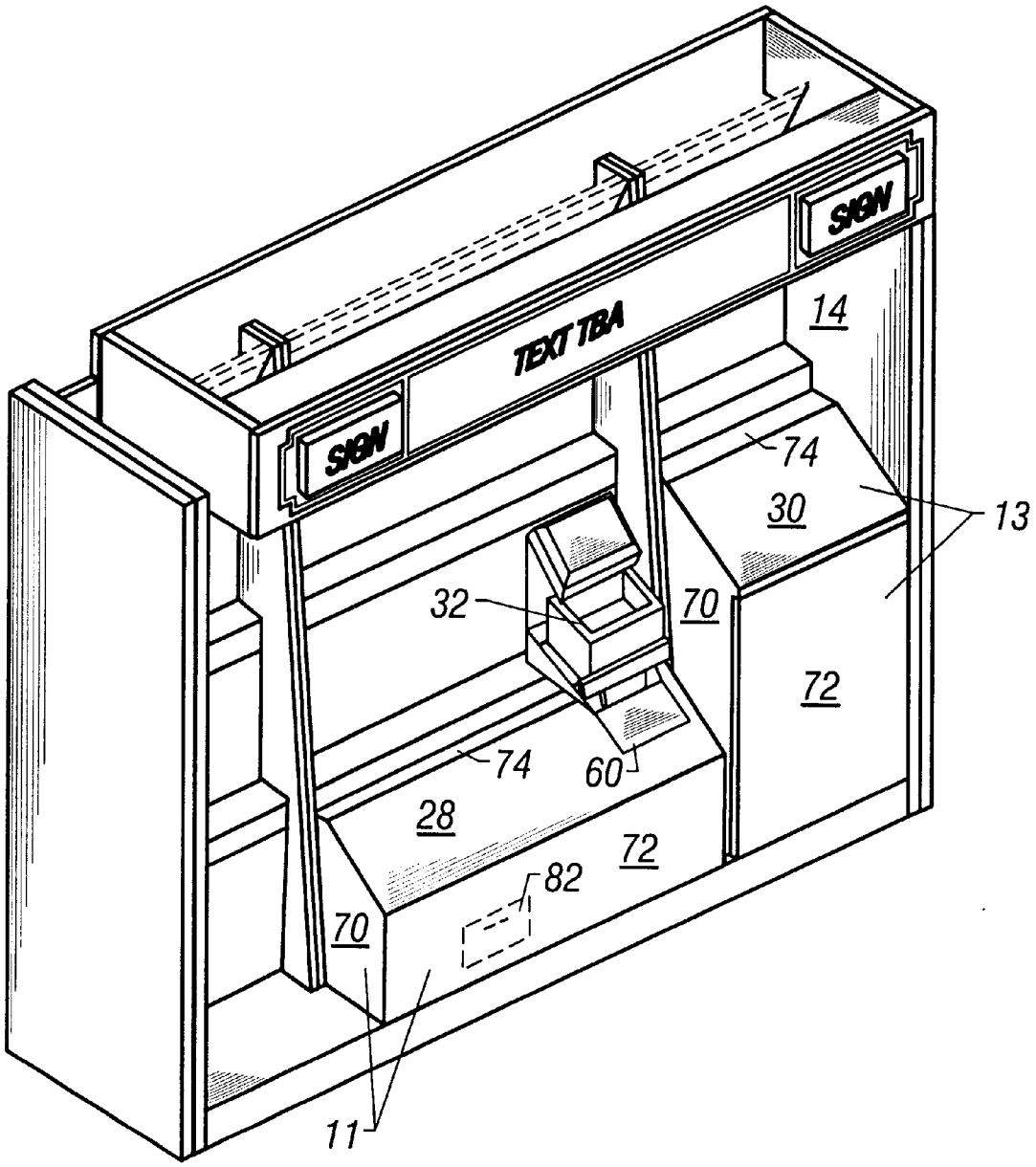
FIG. 4 is an angled front view of a display unit including a cornice assembly secured to the back wall and displaying death care merchandise with full or partial size adornments.

In the preferred embodiment, illustrated in FIGS. 2, 2A, 2B, 2C, 3A and 3B, shelving is used to allow display of death care merchandise. Shelving unit 50 which permits the placement of heavy weights within the display unit comprises back plate 52, shelf surface 54, and shelf attachments 56 and 57. Shelf surface 54 may be angled in relation to back plate 52, as shown in FIG. 2 or may be perpendicular to the back plate. Back plate 52 in particular tends to reduce the natural torque caused within back wall panel 12 thereby increasing its shear strength. As such, it is unnecessary to reinforce back wall panel 12. The spatial arrangement of the shelving unit components renders possible the support of multiple units of miniature death care merchandise such as caskets and burial vaults.

Where the merchandise being displayed are miniature burial vaults, shelf attachment 56 may contain receiving member 56*b* which secures back plate 52 into merchandise attachment point 26. As shown in FIG. 4, flange 56*a* abuts one side of the outer surface of the lid of the burial vault. The miniature burial vault rests on shelf surface 54 by lip 57. In the preferred embodiment shelf surface 54 is of solid construction in order to support as much weight on shelf surface 54 as possible. Further, to enhance the visual experience, shelf surface 54 is angled with respect to shelf support 60. However, it is possible that shelving unit 50 could comprise a shell design of shelf surface 54 and shelf support 60, whereby shelf support 60 is attached to back plate 52. FIG. 2A shows death care merchandise 65 displayed on shelving unit 50.

Figure 2B:
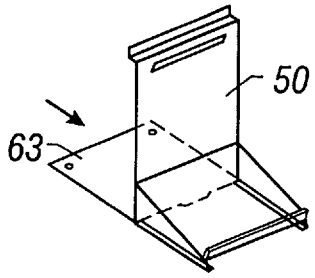
Figure 2C:
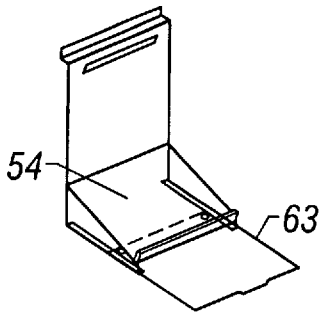
Figure 2D:
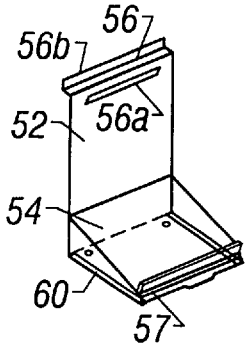

Additionally, shelf support 60 could comprise movable shelf insert 63. As shown in FIG. 2B, movable shelf insert could be attached to shelving unit 50 via runners comprising the bottom edge of shelf surface 54. In FIG. 2 shelf insert 63 is moved into a position of alignment with shelf surface 54. In addition, as shown in FIG. 2C, shelf insert 63 is moved to a position whereby the front edge of shelf insert 63 extends away from shelf 54 and forms a surface where consumers can view death care merchandise in close proximity to the miniature replicas displayed on shelf surface 54. Shelf insert 63, which is typically an acrylic, may laterally coextend from shelf surface 54 or, alternatively, be angled away from shelf surface 54. In a particularly preferred embodiment of the invention where the death care merchandise unit displays miniature burial vaults, shelf insert 63 is used as an informational aid to inform the observer of the specifics of the vault being displayed.

Figure 3A:
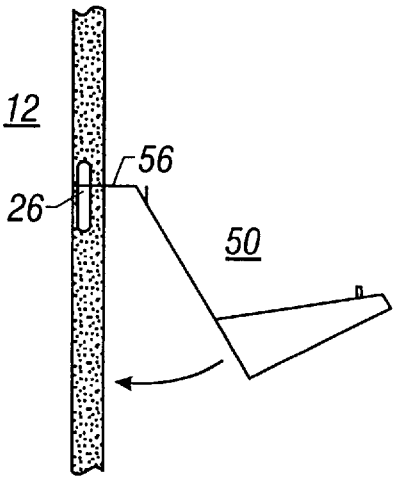
FIGS. 3A and 3B are side views of a shelving attachment for displaying miniature death care merchandise units.
Figure 3B:
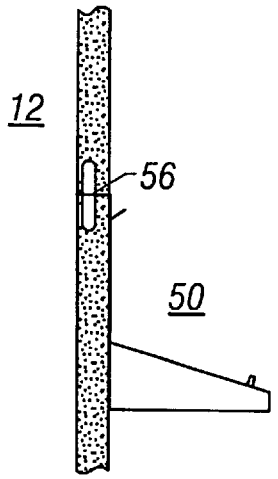

FIGS. 3A and 3B show how shelving unit 50 may be attached to back wall 12 or merchandise support panel 24. Shelf attachment 56 is inserted into merchandise attachment point 26. In order to insert shelf attachment 56, shelving unit 50 must be rotated a set angle away from back wall 12. Shelving unit 50 will thus rotate due to gravity to a position as shown in FIG. 3B. Shelf attachment 56 is constructed such that when shelving unit 50 rotates to the displaying position, shelf attachment 56 will be prohibited from exiting attachment point 26 by the construction of back wall 12. The shelving unit may further be attached by other means known in the art.

Display unit 10 of the invention may also contain one or more surfaces, such as 28 and 30, for the display of ornamental objects. As shown in FIG. 4, ornament surfaces 28 and 30 allow for the easy viewing of ornamentation to be attached to the merchandise represented by miniature replica 32. In addition, and as shown in FIG. 4, shelf insert 62 may be extended into the viewing position with numerous ornaments placed on it in close proximity to replica 32. Alternatively, shelf insert 62 could be used for written information regarding the displayed merchandise.

In the preferred embodiment, as depicted in FIGS. 1 and 4, display unit 10 also has cornice 34. Cornice 34 may contain signage 36 containing line specific or functional specific information about the death care merchandise displayed in display unit 10. Cornice 34 may be attached to display unit 10 either by attaching it to back wall 12, side wing walls 14 or 16, or both. Many modes of connecting a cornice are known, and detail is not paid to an exact means of attachment.

The back wall panel and side wing wall panels of the display unit of the invention are typically plywood but may be fiberwood or other durable material such as a synthetic plastic material as plexiglass or Mylar. The back wall panel and side wing wall panels may be covered with a fabric-like material or have a textured surface. When so desired, one may removably attach the fabric-like material to the panel allowing the user to select the color and texture. The side wing and back wall panels, illustrated in FIGS. 1 and 4 are typically 5 to 8 feet tall. In the preferred embodiment they are 7'6" feet tall.

Figure 6:
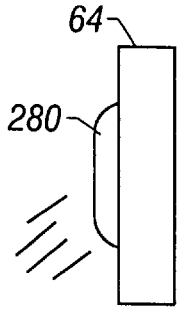
FIGS. 6 and 6A are diagrams showing adaptable lighting on the display unit.

The cornice 34 can conceal an illumination source 280 from the observer. The interior of the cornice 34 conceals attached illumination source 280 outside the view of a consumer. Illumination source 280 may be concealed within the vertical interior surfaces 60, 62, and 64 of cornice 34. FIG. 6 illustrates this feature. Exemplary of the illumination source are one or more track lights which one may easily manipulate such that the light is directed onto selected merchandise within the display unit. Conventional screws or nuts and bolts can secure track lights to the vertical interior surfaces 60, 62, and 64 of cornice 34. One should note that one could use this illumination system on side wing walls 14 and 16, or on back wall panel 12 as well.

Figure 6A:
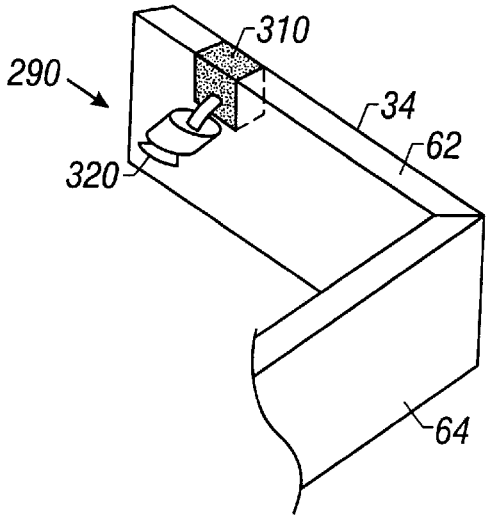

In an alternative embodiment, illustrated in FIG. 6*a*, one attaches an illumination unit 290 to cornice 34. The illumination unit comprises clip 310 and illumination source 320. One attaches illumination unit 290 to the top surface of cornice 34 via clip 310. One adapts clip 310 to securely hold illumination unit 290 to cornice 34. Again one should note that one could use this method of illumination on side wing wall panels 14 and 16, or on back wall panel 12 as well.

In a preferred embodiment of the invention, the subsections are arranged in descending step fashion from the top of the unit. The stair-step arrangement of the surfaces serves to maximize the lighting from the illumination system. Referring again to FIG. 1, subsections 23, 27 and 29 are the subsections closest to back wall 12. In fact, these subsections may actually comprise a portion of back wall 12. Merchandise support panel 24*a* and 24*b* are separated from subsections 23 and 27, respectively by ledge 25*a* and 25*b*. The frontal surface of merchandise support panels 24*a* and 24*b* extends from the side surface of ledge 25*a* and 25*b*. Merchandise attachment points 26*a* and 25*b* separate the side of ledge 25*a* and 25*b* from the frontal surface of merchandise support panel 24*a* and 24*b*. Merchandise support panel 24*a* and 24*b* are a greater distance from back wall panel 12 than subsections 23 and 27. Merchandise support panel 29*a* is separated from merchandise support panel 24*a* by means of ledge 27*a*. Ledge 27*a* causes merchandise support panel 29*a* to extend a greater distance from back wall panel 12 than merchandise support panel 24*a*. Again ledge 27*a* is separated from merchandise support panel 29*a* by merchandise attachment point 31*a*. Referring to the center section of display unit 10 ledge 27*b* defines the distance which ornament surface 28 extends from merchandise support panel 24*b*. As is evident from FIG. 1, ornament surface 28 is a greater distance from back wall panel 12 than merchandise support panel 24*b*. For greater visibility, ornament surface 28 is angled away from the vertical plane which defines back wall panel 12.

In one embodiment of the invention, as illustrated in FIG. 4, the display unit contains one or more modular ensembles, such as modular ensemble 11 or 13. Such modular ensembles are defined by top surfaces 28 or 30, side wall 70, frontal surface 72 and horizontal bar 74. The horizontal bar 74 is planar to ledge 27*b* (for modular ensemble 11) or ledge 25*c* (for modular ensemble 13). In order to maximize the illumination means, top surface 28 or 30 is angled away from the vertical plane defined by horizontal bar 74. It should be noted that these surfaces could also be flat, or perpendicular relative to back wall 12 as well. Such modular ensembles could form an integral part of display unit 10 as a "built-in" or be removable from the display unit. Where the ensemble is an integrated part of the display unit it may be secured to the back wall by means of skill in the art, such as by an interlocking French cleat.

As illustrated in FIG. 4, modular ensemble 11 may be further modified by having one or more pullout drawers 82. The pullout drawer could contain shelving for positioning of a decedent confinement unit. Such shelving may be retractable from the drawer. For aesthetic purposes, it may be desirable for such drawers to contain less aesthetically pleasing units. For instance, when display unit 10 is for the display of burial vaults, it may be desirable that drawer 82 contain concrete liners or other concrete boxes lacking reinforcements.

Figure 7:
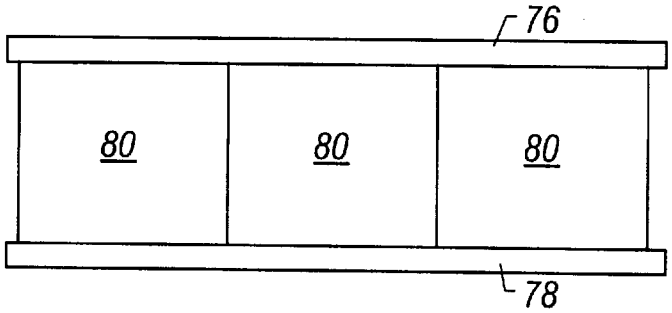
FIG. 7 is a view of the top surface of a modular ensemble of the display unit within the invention.

In a preferred embodiment, top surface 28 of modular ensemble 11 is used to display external ornamentation for the death care merchandise, preferably burial vaults. In one embodiment, set forth in FIG. 7, top surface 28 may be further defined as having top and bottom lips 76 and 78. One or more removable panels 80 containing adornment articles are inserted under lips 76 and 78.

A second modular ensemble 13 may further be the chamber for one or more decedent confinement miniature units such as caskets or burial vaults. Where the display unit is used for burial vaults, surface 30 is typically used to display information about the merchandise including text, graphics and photographs. In one instance, surface 30 is used to display information about the internment process and the role played by burial vaults in the process.

Figure 5:
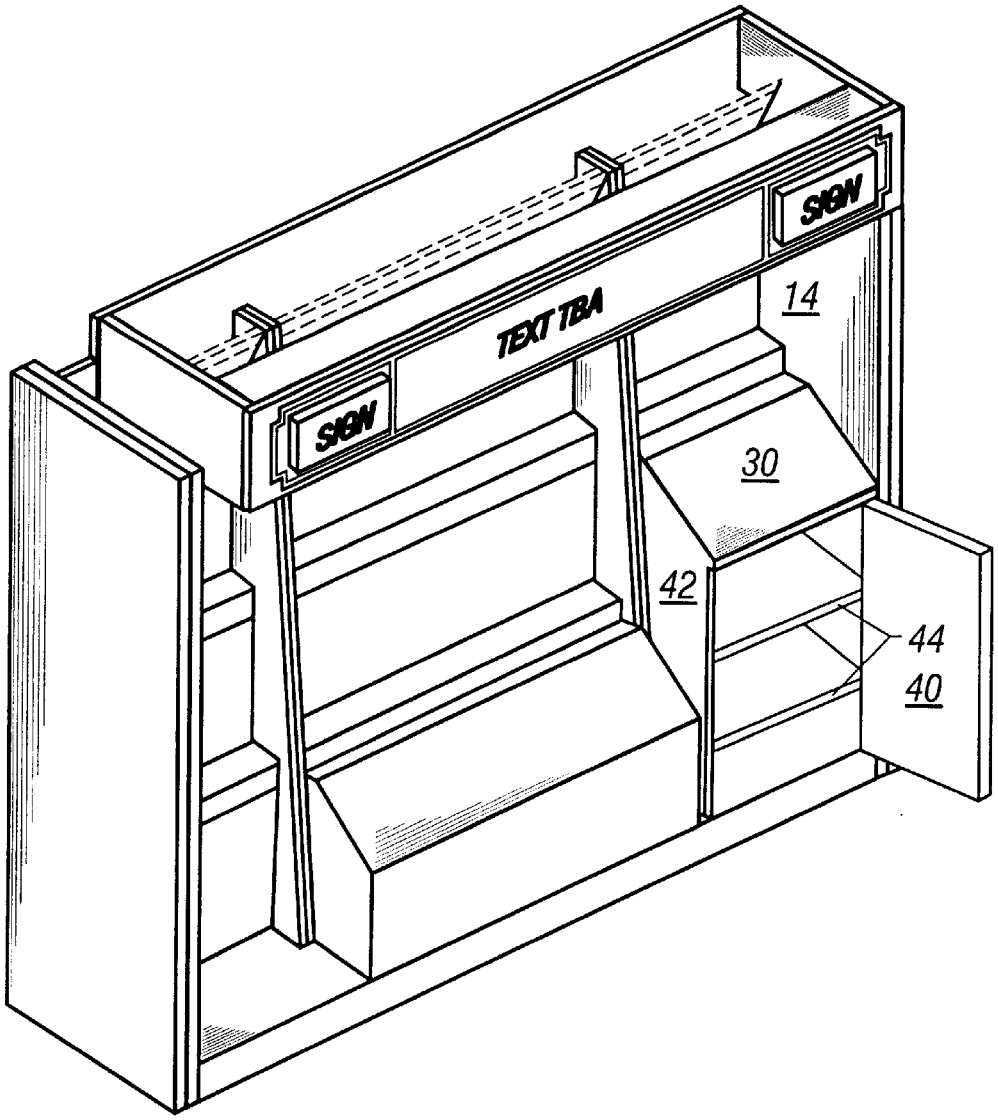
FIG. 5 is a frontal view of one embodiment of the display unit of the invention emphasizing a storage section.

As illustrated in FIG. 5, ensemble 13 may contain one or more shelves 44 for placement of the miniature units. Equipped with door 40, such units may include aesthetically unappealing concrete liners and other merchandise. The shelving may be adjustable. Preferably, these shelves are attached in a manner by which they may be extended outward when pulled. Most preferably, these shelves are attached by a roller mechanism allowing the contents of shelving 44 to be viewed in an easy manner. Like ensemble 11, ensemble 13 may be an integral part of the display unit or be free-standing for insertion into the display unit.

Either ensemble 11 or 13 may be modified for placement of a computer or audiovisual aids, surface 28 or 30 serving to hold a monitor, television or other visual aid.

Various modifications may be made in the nature, composition, operation and arrangement of the various elements, steps and procedures described herein without departing from the spirit and scope of the invention as defined in the following claims.

We claim:

1. A death care merchandise display unit comprising:

a plurality of side wing walls;

a back wall having lateral edges connected to the rear edges of the wing walls whereby the side wing walls and the back wall maintain each other in an upright position when the display unit is in a set up, displayed state;

two or more horizontal display surfaces positioned between the side walls and the back wall said horizonal display surfaces being vertically spaced such that the top of an uppermost horizontal display surface is closest to the back wall while a bottommost horizontal display surface is of the greatest distance from the back wall; and a cornice attached to the display unit.

2. The display unit of claim 1 further comprising a floor plate.

3. The display unit of claim 2 whereby the floor plate is attached to the two side wing walls.

4. The display unit of claim 2 whereby the floor plate is attached to the back wall.

5. A death care merchandise display unit comprising:

a plurality of side wing walls;

a back wall having lateral edges connected to the rear edges of the wing walls whereby the side wing walls and the back wall maintain each other in an upright position when the display unit is in a setup, displayed state;

two or more horizontal display surfaces positioned between the sidewalls and the back wall, said horizontal display surfaces being vertically spaced such that an uppermost horizontal display surface is closest to the back wall while a bottommost horizontal display surface is of the greatest distance from the back wall;

wherein the back wall is vertically divided into two or more subpanels.

6. The display unit of claim 1 containing three horizontal display surfaces wherein a middle horizontal display surface is further removed from the back wall than the uppermost horizontal display surface but not as removed from the back wall as the bottommost horizontal display surface.

7. The display unit of claim 5 further comprising a cornice attached to the display unit.

8. The display unit of claim 7 wherein the cornice is attached to the back wall panel.

9. The display unit of claim 7 wherein the cornice is attached to the side wall walls.

10. The display unit of claim 7 further comprising a lighting source attached to the cornice.

11. The display unit of claim 1 wherein a lighting source is attached to at least one of said side wing walls.

12. The display unit of claim 10 containing three horizontal display surfaces laterally extending from the back wall wherein the middle horizontal display surface is further removed from the back wall than the top horizontal display surface but not as removed from the back wall as the bottommost horizontal display surface.

13. The display unit of claim 11 containing three horizontal display surfaces laterally extending from the back wall wherein the middle horizontal display surface is further removed from the back wall than the top horizontal display surface but not as removed from the back wall as the bottommost horizontal display surface.

14. The display unit of claim 1 further comprising a modular ensemble unit.

15. The display unit of claim 14 wherein the modular ensemble unit is an integral part of the display unit.

16. The display unit of claim 14 wherein the modular ensemble unit contains at least one drawer.

17. The display unit of claim 16 wherein the modular ensemble unit comprises extendable drawers.

18. The display unit of claim 15, wherein the modular ensemble unit is made an integral part of the display unit by attaching the modular ensemble unit to the display unit by a French cleat.

19. The display unit of claim 2, wherein the floor plate supports a modular ensemble unit.

20. The display unit of claim 14, wherein said modular ensemble unit further comprises a door.

21. A death care merchandise display unit comprising:

a plurality of side wing walls;

a back wall connected to said wing walls;

at least two horizontal display surfaces positioned between the side walls and the back wall such that said horizontal display surfaces are vertically spaced such that an uppermost horizontal display surface is closest to the back wall, while a bottommost horizontal display surface is at a greatest distance from the back wall than said uppermost display surface and further comprising at least one shelf; wherein said shelf comprises a back plate and a shelf surface extending from said back plate; an uppermost portion of said back plate being received within a slot in said display unit to support said shelf.

22. The display unit of claim 21 further comprising at least one miniature burial vault resting on said shelf.

23. The display unit of claim 1, further comprising at least one sub-divider separating various sections of the display system.

24. The display unit of claim 21, further comprising at least one sub-divider separating various sections of the display system.

* * * * *